US007278890B1

(12) United States Patent
Smutny et al.

(10) Patent No.: US 7,278,890 B1
(45) Date of Patent: Oct. 9, 2007

(54) ELECTRICAL CONNECTOR WITH SECONDARY LOCK

(75) Inventors: Dale J. Smutny, Canfield, OH (US); Lisa J. McClearn, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/493,264

(22) Filed: Jul. 26, 2006

(51) Int. Cl.
*H01R 13/514* (2006.01)

(52) U.S. Cl. ..... 439/752

(58) Field of Classification Search ..... 439/752, 439/595, 744
See application file for complete search history.

(56) References Cited

U.S. PATENT DOCUMENTS

| | | | | |
|---|---|---|---|---|
| 4,867,712 | A * | 9/1989 | Kato et al. | 439/752 |
| 5,203,722 | A | 4/1993 | Kinoshita | |
| 5,252,096 | A * | 10/1993 | Okada | 439/752 |
| 5,503,573 | A * | 4/1996 | Sagawa | 439/752 |
| 5,797,772 | A * | 8/1998 | Sakurai et al. | 439/752 |
| 2006/0046581 | A1 * | 3/2006 | Okamoto et al. | 439/752 |
| 2006/0110989 | A1 * | 5/2006 | Lee et al. | 439/752 |

* cited by examiner

*Primary Examiner*—Michael C. Zarroli
*Assistant Examiner*—Phuongchi Nguyen
(74) *Attorney, Agent, or Firm*—David P. Wood

(57) ABSTRACT

An electrical connector comprises a connector body having rows of longitudinal terminal cavities that are separated by internal partition walls of the connector body and that extend from an insertion end to a mating end for receiving electrical terminals attached to conductor wires. The connector body has primary terminal locks in the terminal cavities for retaining the electrical terminals in the terminal cavities. The connector body has a transverse slot that extends through a floor and intersects the rows of terminal cavities. A secondary lock fits into the transverse slot for retaining the electrical terminals in the terminal cavities. The secondary lock has lock nibs that engage internal partition walls of the connector body to hold the secondary lock in a preload position that permits insertion of the electrical terminals into the terminal cavities via openings at the insertion end of the connector body. The secondary lock has lock wedges that engage the floor of the connector body to hold the secondary lock in a lock position that prevents withdrawal of the electrical terminals in the terminal cavities via the openings at the insertion end of the connector body.

4 Claims, 3 Drawing Sheets

ELECTRICAL CONNECTOR WITH SECONDARY LOCK

BACKGROUND OF THE INVENTION

This invention relates generally to an electrical connector and more particularly to an electrical connector having a secondary lock for retaining terminals in the terminal cavities of a connector body.

U.S. Pat. No. 5,203,722 issued to Yoshiji Kinoshita Apr. 30, 1993, discloses double lock electrical connector comprising a connector body having terminal cavities in which terminals are retained by internal lances. A double locking device is inserted through an opening in the connector body and held in a first (prestage) position by lateral lugs engaging internal depressions in the side walls of the connector body. This position allows insertion of the terminals into the terminal cavities. After insertion, locking device is then moved to a final locking position and held there by lugs engaging the top surface of the bottom wall of the connector body.

SUMMARY OF THE INVENTION

An electrical connector comprises a connector body having at least one row of longitudinal terminal cavities that are separated by internal partition walls of the connector body and that extend from an insertion end to a mating end for receiving electric terminals attached to conductor wires. The connector body has primary terminal locks in the one row of longitudinal terminal cavities for retaining the electrical terminals in the one row of longitudinal terminal cavities. The connector body has a transverse slot that extends through a floor of the connector body and intersects the one row of longitudinal terminal cavities. A secondary lock fits into the transverse slot for retaining the electrical terminals in the one row of longitudinal terminal cavities. The secondary lock has at least one lock nib that engages one of the internal partition walls of the connector body to hold the secondary lock in a preload position that permits insertion of the electrical terminals into the one row of terminal cavities via openings at the insertion end of the connector body. The secondary lock has at least one lock wedge that engages the floor of the connector body to hold the secondary lock in a lock position that prevents withdrawal of the electrical terminals in the one row of terminal cavities via the openings at the insertion end of the connector body.

DETAILED DESCRIPTION OF THE PREFERRED EMBODIMENTS

Figure 2:
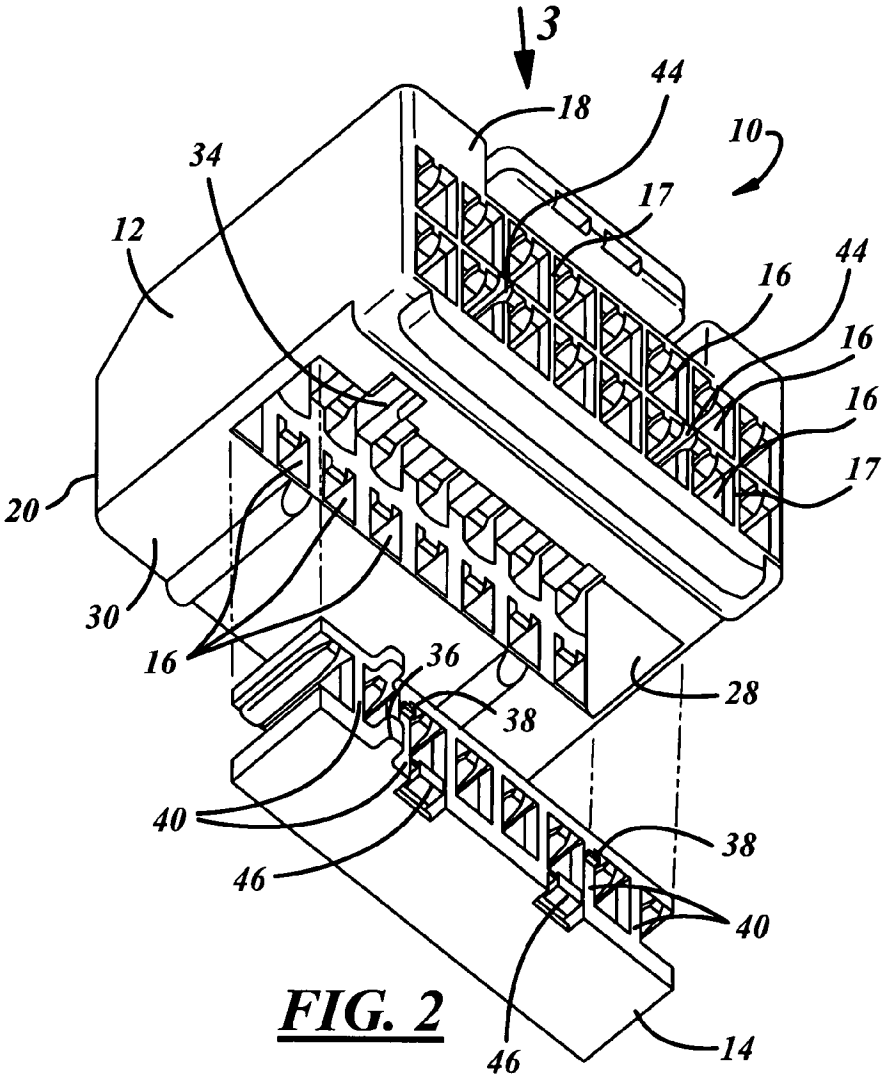
FIG. 2 is another exploded perspective view of the electrical connector shown in FIG. 1.
Figure 1:
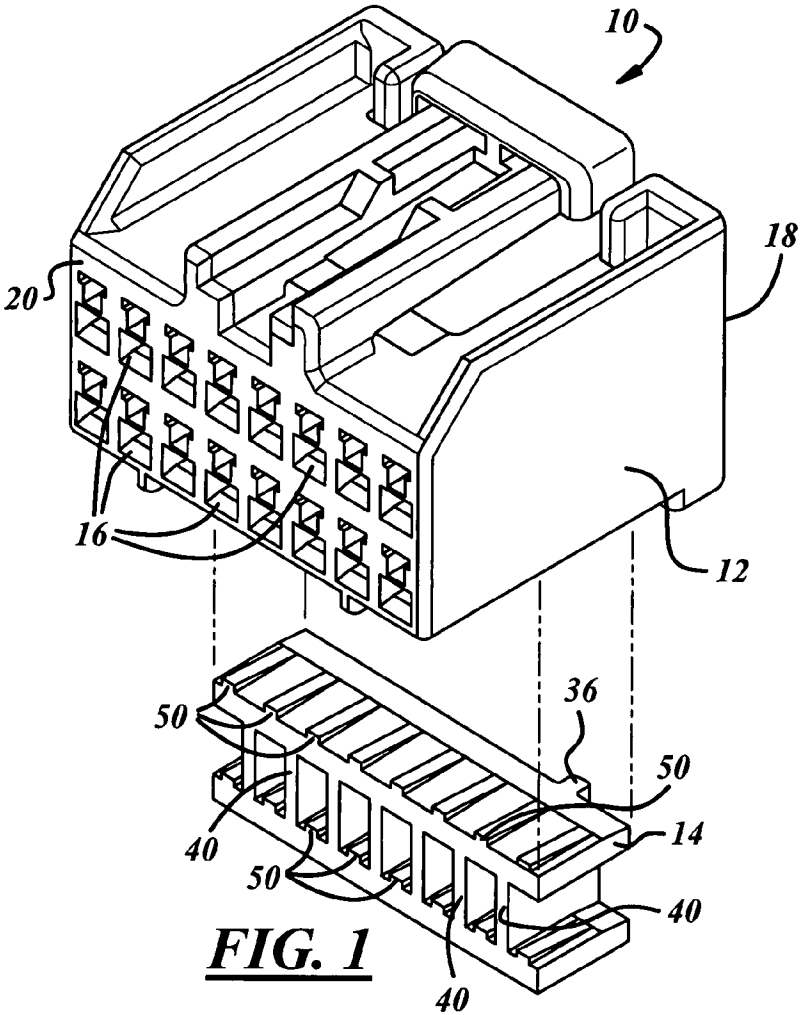
FIG. 1 is an exploded perspective view of an electrical connector comprising a connector body, a secondary lock, and electrical terminals (not shown)
Figure 3:
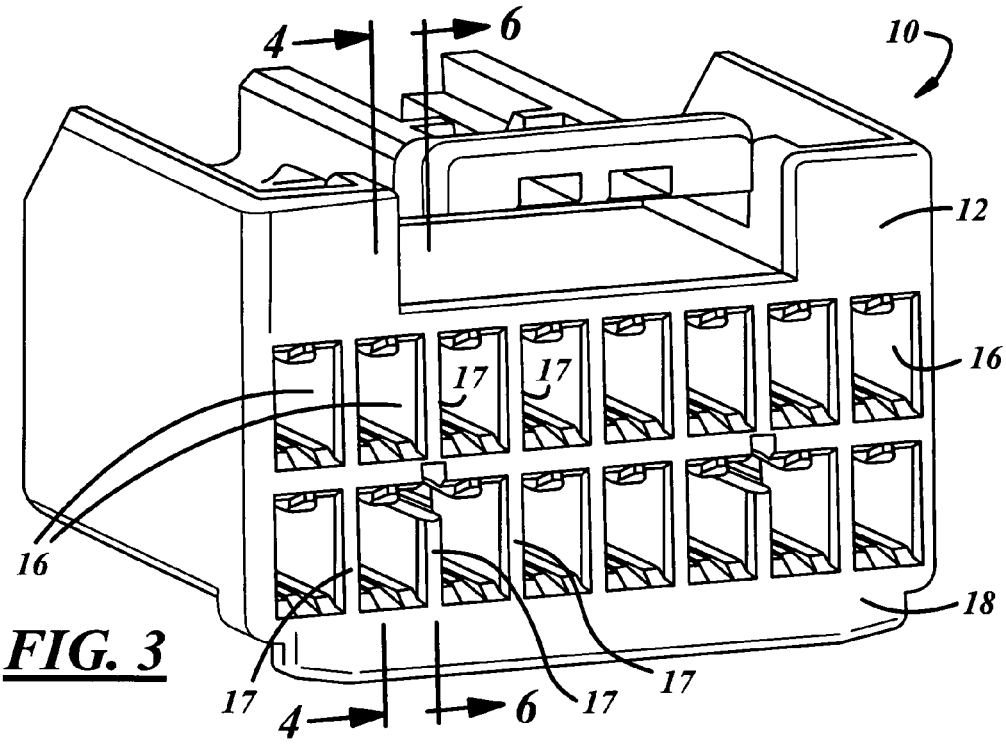
FIG. 3 is a perspective view of the electrical connector shown in FIG. 1.

Referring now to the drawing, an electrical connector 10 comprises a connector body 12 and a secondary lock 14.

Figure 4:
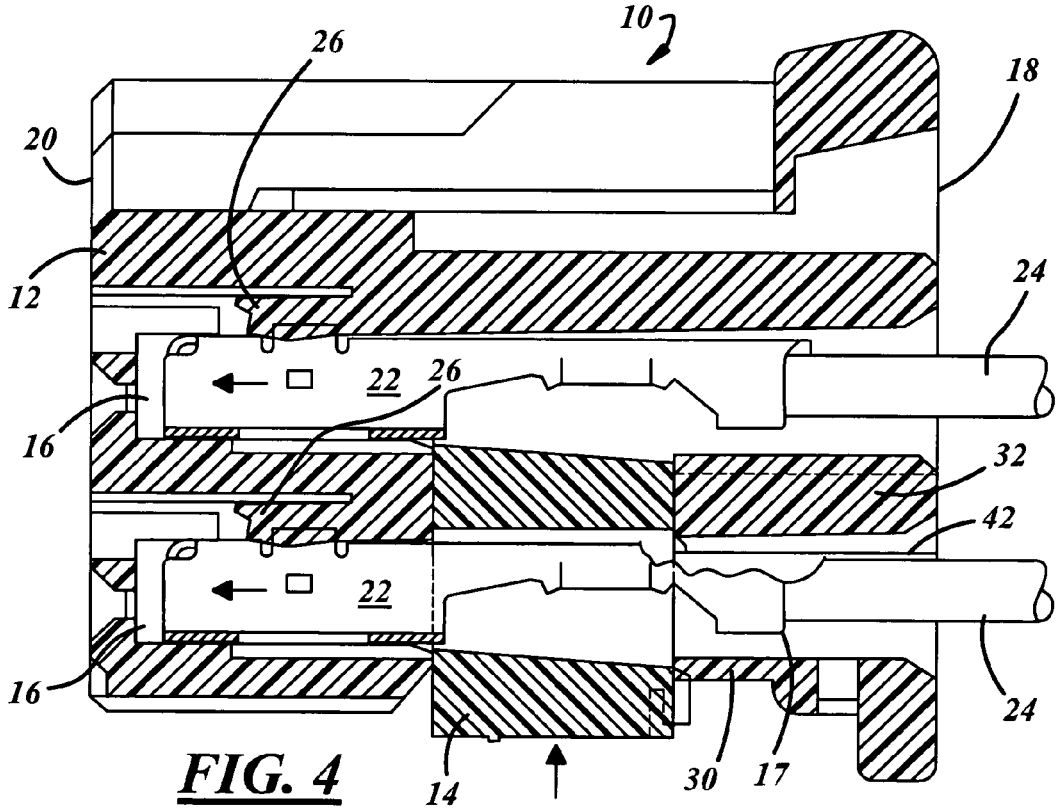
FIG. 4 is a section taken substantially along the line 4-4 of FIG. 3 looking in the direction of the arrows showing the secondary lock in a preload position.
Figure 5:
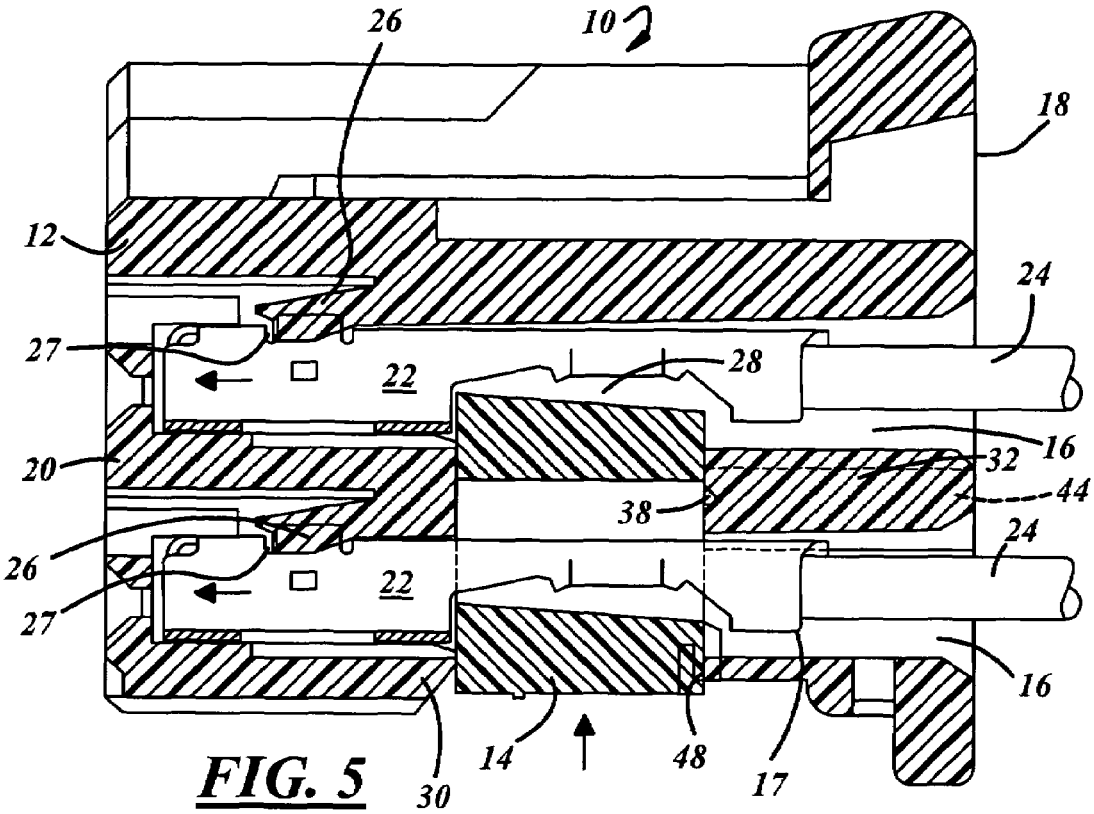
FIG. 5 is a view similar to FIG. 4 showing the secondary lock in a terminal lock position.

Connector body 12 has two rows of longitudinal terminal cavities 16. The longitudinal terminal cavities 16 in each row are separated by internal partition walls 17 and extend through the connector body from an insertion end 18 to a mating end 20. Each of the longitudinal terminal cavities may receive an electrical terminal 22 that is attached to an insulated conductor wire 24 via an opening at the insertion end of the connector body 12 as shown in FIGS. 4 and 5. Each terminal 22 is inserted into one of the terminal cavities 16 through the opening at the insertion end 18 and retained in the terminal cavity by a primary terminal lock 26, such as a flexible cantilevered lock arm of the connector body 12 that engages behind a forward lock shoulder 27 of each terminal.

Secondary lock 14 provides a secondary lock for all of the electrical terminals 22 that are inserted into the terminal cavities 16 after the terminals are locked in their respective terminal cavities by the primary terminal locks 26.

Connector body 12 has a transverse slot 28 that extends through a floor 30 of the connector body 12 and intersects the two rows of longitudinal terminal cavities 16. In the case of connector bodies having multiple rows of terminal cavities such as the connector body 12 having upper and lower rows of terminal cavities, the transverse slot 28 cuts completely through the terminal cavities and partition walls in the lower row but may cut only part way into the terminal cavities and partition walls in the upper row as best shown in FIG. 2. Secondary lock 14 fits into the transverse slot 28 for retaining the electrical terminals 22 in the longitudinal terminal cavities 16 as a back-up for the primary terminal locks 26.

The floor 30 of the connector body 12 and an internal ceiling wall 32 above the terminal cavities 16 that are bound by floor 30 have aligned orientation grooves 34 that communicate with the transverse slot. The orientation groove 34 in floor 30 is shown in FIG. 2. However, the aligned orientation groove in the internal ceiling wall 32 is not visible in this view. The secondary lock 14 has aligned orientation lugs 36 that fit into the orientation grooves 34 to insure that the secondary lock 14 is properly oriented for insertion into the transverse slot 28 of connector body 12.

Figure 6:
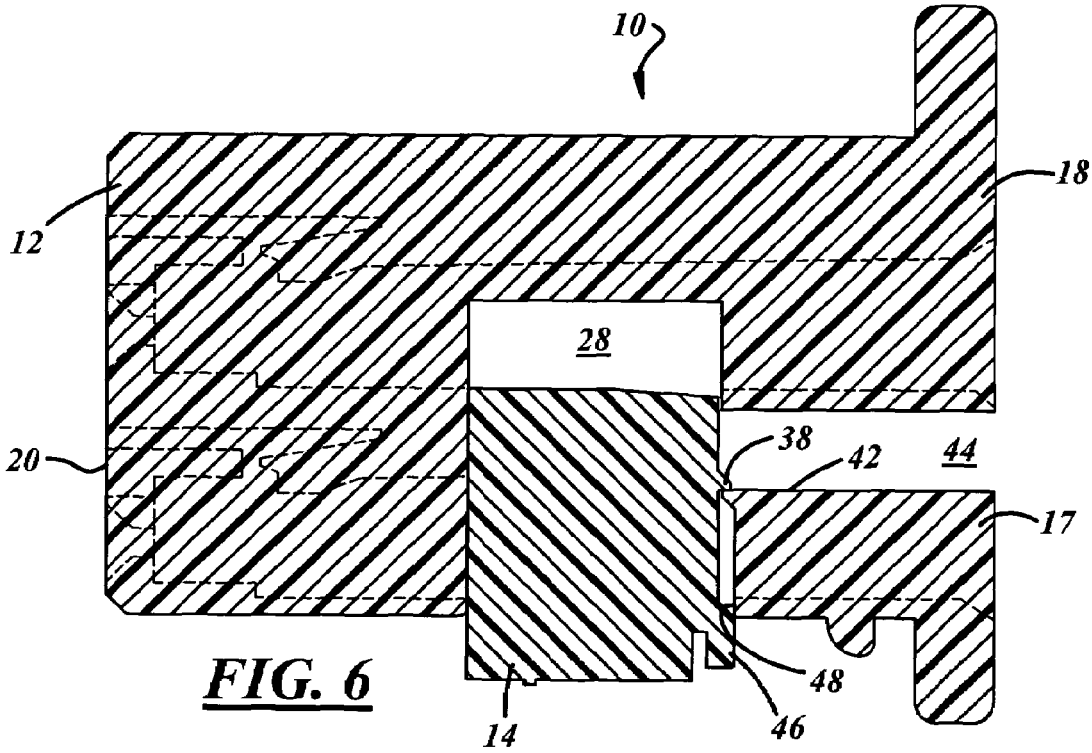
FIG. 6 is a section taken along the line 6-6 of FIG. 4 looking in the direction of the arrows.

The secondary lock 14 is initially inserted part way into the transverse slot 28 and held in a pre-load position by lock nibs 38 that project rearwardly from partition walls 40 of secondary lock 14 that align with partition walls 17 of the connector body 12. Lock nibs 38 engage longitudinal ledges 42 of respective partition walls 17 of the connector body 12 as best shown in FIGS. 4 and 6. Ledges 42 may be provided by longitudinal slots 44 in these respective partition walls 17 that extend inward from the insertion end of the connector body 12 as best seen in FIG. 2. When the secondary lock 14 is held in the pre-load position by the lock nibs 30, insertion of the electrical terminals 22 into the rows of terminal cavities 16 via the openings at the insertion end 18 of the connector body 12 is permitted as shown in FIG. 4.

The secondary lock 14 has lock wedges 46 that project rearwardly from the secondary lock that engage a face 48 of the connector body floor 30 at the slot 28 to assist the lock nibs 38 in holding the secondary lock is in the pre-load position as shown in FIG. 6.

After the electrical terminals 22 are loaded into the rows of terminal cavities 16, the secondary lock 14 is pushed fully into the transverse slot 28 to a terminal lock position and the lock wedges 46 that project rearwardly from the secondary lock 14 fully engage the face 48 of the connector body floor 30 at the slot 28 to hold the secondary lock in the terminal lock position. When the secondary lock 14 is in the terminal lock position, withdrawal of the electrical terminals 22 in the rows of terminal cavities 16 via the openings at the insertion end 18 of the connector body 12 is prevented by lock portions 50 of the secondary lock 14 being located behind rearward lock shoulders 52 of the terminals 22 as best seen in FIG. 5. Thus the secondary lock 14 acts as a back-up for the primary terminal locks 26 that prevent withdrawal of the terminals 22 via the openings at the insertion end 18 of the connector body 12.

While the electrical connector 10 is illustrated as having two rows of longitudinal terminal cavities 16, the electrical connector 10 may have one or several rows of longitudinal terminal cavities, and the secondary lock 14 may be used to provide a secondary lock for one or more of the several rows of terminal receiving cavities.

In other words, it will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector comprising:

a connector body having at least one row of longitudinal terminal cavities that are separated by single internal partition walls of the connector body and that extend from an insertion end to a mating end for receiving electrical terminals attached to conductor wires, the connector body having primary terminal locks in the one row of longitudinal terminal cavities for retaining the electrical terminals in the one row of longitudinal terminal cavities, the connector body having a transverse slot that extends through a floor of the connector body and intersects the one row of longitudinal terminal cavities, a secondary lock that fits into the transverse slot for retaining the electrical terminals in the one row of longitudinal terminal cavities, the secondary lock having at least one lock nib that extends from a single partition wall of the secondary lock and that engages a ledge of one of the single internal partition walls of the connector body to hold the secondary lock in a preload position that permits insertion of the electrical terminals into the one row of terminal cavities via openings at the insertion end of the connector body, and the secondary lock having at least one lock wedge that engages the floor of the connector body to prevent withdrawal of the secondary lock from the connector body and hold the secondary lock in a lock position that prevents withdrawal of the electrical terminals in the one row of terminal cavities via the openings at the insertion end of the connector body.

2. An electrical connector comprising:

a connector body having at least one row of longitudinal terminal cavities that are separated by single internal partition walls of the connector body and that extend from an insertion end to a mating end for receiving electric terminals attached to conductor wires, the connector body having primary terminal locks in the one row of longitudinal terminal cavities engaging forward lock shoulders of the electrical terminals for retaining the electrical terminals in the one row of longitudinal terminal cavities, the connector body having a transverse slot that extends through a floor of the connector body and intersects the one row of longitudinal terminal cavities, a secondary lock that fits into the transverse slot for engaging rearward lock shoulders of the electrical terminal to retain the electrical terminals in the one row of longitudinal terminal cavities, the secondary lock having lock nibs that extend rearwardly from single internal partition walls of the secondary lock and engage ledges of respective ones of the single internal partition walls of the connector body to hold the secondary lock in a preload position that permits insertion of the electrical terminals into the one row of terminal cavities via openings at the insertion end of the connector body, and the secondary lock having lock wedges that engage the a face of the floor of the connector body at the transverse slot to hold the secondary lock in a lock position that prevents withdrawal of the electrical terminals in the one row of terminal cavities via the openings at the insertion end of the connector body, wherein the ledges of the single internal partition walls are provided by slots that extend inward from the insertion end of the connector body.

3. An electrical connector comprising:

a connector body having at least one row of longitudinal terminal cavities that are separated by internal partition walls of the connector body and that extend from an insertion end to a mating end for receiving electric terminals attached to conductor wires, the connector body having primary terminal locks in the one row of longitudinal terminal cavities engaging forward lock shoulders of the electrical terminals for retaining the electrical terminals in the one row of longitudinal terminal cavities, the connector body having a transverse slot that extends through a floor of the connector body and intersects the one row of longitudinal terminal cavities, a secondary lock that fits into the transverse slot for engaging rearward lock shoulders of the electrical terminal to retain the electrical terminals in the one row of longitudinal terminal cavities, the secondary lock having lock nibs that engage ledges of respective ones of the internal partition walls of the connector body to hold the secondary lock in a preload position that permits insertion of the electrical terminals into the one row of terminal cavities via openings at the insertion end of the connector body, and the secondary lock having lock wedges that engage the a face of the floor of the connector body at the transverse slot to hold the secondary lock in a lock position that prevents withdrawal of the electrical terminals in the one row of terminal cavities via the openings at the insertion end of the connector body, wherein the floor of the connector body has a orientation groove that communicates with the transverse slot and the secondary lock has an orientation lug that fits into the orientation groove that provide asymmetrical means for insuring that the secondary lock is properly oriented for insertion into the connector body.

4. An electrical connector comprising:

a connector body having plural rows of longitudinal terminal cavities with each row having longitudinal terminal cavities that are separated by internal partition walls of the connector body and that extend from an insertion end to a mating end for receiving electric terminals attached to conductor wires, the connector body having primary terminal locks in the plural rows of longitudinal terminal cavities for retaining the electrical terminals in the plural rows of longitudinal terminal cavities, the connector body having a transverse slot that extends through a floor of the connector body and intersects the plural rows of longitudinal terminal cavities, a secondary lock that fits into the transverse slot for retaining the electrical terminals in the plural rows of longitudinal terminal cavities, the secondary lock having lock nibs that engage ledges of respective ones of the internal partition walls of the connector body to hold the secondary lock in a preload position that permits insertion of the electrical terminals into the plural rows of terminal cavities via openings at the insertion end of the connector body, and the secondary lock having at lock wedges that engage the a face of the floor of the connector body at the transverse slot to prevent withdrawal of the secondary lock from the connector body and hold the secondary lock in a lock position that prevents withdrawal of the electrical terminals in the several rows of terminal cavities via the openings at the insertion end of the connector body, wherein the ledges are in the partition walls of the terminal cavities adjacent the floor of the connector body and the ledges are provided by slots that extend inward from the insertion end of the connector body, and wherein the floor of the connector body and an internal ceiling wall above the terminal cavities that are bound by the floor of the connector body have aligned orientation grooves that communicate with the transverse slot and the secondary lock has aligned orientation lugs that fit into the orientation grooves that provide asymmetrical means for insuring that the secondary lock is properly inserted into the transverse slot of the connector body.

* * * * *